US007850164B2

(12) United States Patent
Ahn et al.

(10) Patent No.: US 7,850,164 B2
(45) Date of Patent: Dec. 14, 2010

(54) CASSETTE WITH SPACERS FOR ADJUSTING THE POSITION OF A CURRENCY NOTE GUIDE STRUCTURE FOR ASSURING CORRECT MOUNTING FOR AN AUTOMATIC TELLER MACHINE

(75) Inventors: Jin Hyuk Ahn, Gyunggi do (KR); Dong Sik Lee, Seoul (KR)

(73) Assignee: Nautilus Hyosung Inc. (KR)

( * ) Notice: Subject to any disclaimer, the term of this patent is extended or adjusted under 35 U.S.C. 154(b) by 90 days.

(21) Appl. No.: 11/144,737

(22) Filed: Jun. 6, 2005

(65) Prior Publication Data

US 2006/0157916 A1 Jul. 20, 2006

(30) Foreign Application Priority Data

Dec. 24, 2004 (KR) ..... 10-2004-0112511

(51) Int. Cl.
*B65H 1/00* (2006.01)

(52) U.S. Cl. ..... 271/162; 271/149; 271/160; 109/47; 232/1 D; 194/206; 209/534

(58) Field of Classification Search ..... 271/162, 271/149, 160, 145, 198, 197, 287; 109/47; 312/330.1, 348.3, 348.2; 232/15, 16, 1 D; 194/206, 207; 209/534
See application file for complete search history.

(56) References Cited

U.S. PATENT DOCUMENTS 4,704,061 A * 11/1987 Peebles ..... 414/405
5,871,209 A * 2/1999 Orchard et al. ..... 271/149
6,026,967 A * 2/2000 Isaacs et al. ..... 209/539
6,820,872 B2 * 11/2004 Ko et al. ..... 271/162
7,097,172 B2 * 8/2006 Chang ..... 271/171
2002/0056960 A1 * 5/2002 Bergeron et al. ..... 271/145
2003/0111789 A1 * 6/2003 Jun ..... 271/145
2004/0173672 A1 * 9/2004 Washington et al. ..... 235/379
2006/0226594 A1 * 10/2006 McAlpine et al. ..... 271/149

FOREIGN PATENT DOCUMENTS

KR 1020030055967 A 7/2003

* cited by examiner

*Primary Examiner*—Stefanos Karmis
*Assistant Examiner*—Gerald W McClain
(74) *Attorney, Agent, or Firm*—Hershkovitz & Associates, LLC; Abraham Hershkovitz

(57) ABSTRACT

A cassette for a currency note dispensing machine, in which the cassette is slidably mounted to easily fill with currency note, can receive various kinds of currency note by adjusting a currency note guide, and prevent wrong mounting of a push plate to smoothly pay the currency note. The cassette includes a cassette housing formed in a box shape with an upper surface opened, in which currency note vertically stands up and stacks, slidably mounted to a main frame of the currency note dispensing machine, and having a groove for establishing sheet separating means at one side of a rear plate so that currency note contacts with the sheet separating means after one edge of the currency note is supported, and a push plate supporting the currency note stacked between a front plate of the cassette housing and the rear plate and coupled to a resilient member to press the currency note toward the rear plate of the cassette housing.

6 Claims, 6 Drawing Sheets

CASSETTE WITH SPACERS FOR ADJUSTING THE POSITION OF A CURRENCY NOTE GUIDE STRUCTURE FOR ASSURING CORRECT MOUNTING FOR AN AUTOMATIC TELLER MACHINE

CROSS-REFERENCE TO RELATED APPLICATIONS

This application claims priority under 35 USC §119 to Korean Patent Application No. 10-2004-0112511 filed on Dec. 24, 2004, the contents of which are incorporated herein by reference in its entirety.

BACKGROUND OF THE INVENTION

1. Field of the Invention

The present invention relates to a cassette, in which currency note is stacked, for a currency note dispensing machine, and more particularly to a cassette for a currency note dispensing machine, in which the cassette is slidably mounted to easily fill with currency note, can receive various kinds of currency note by adjusting a currency note guide, and prevent wrong mounting of a push plate to smoothly pay the currency note.

2. Description of the Prior Art

Automatic teller machines (ATMs) have been developed to quickly and conveniently provide banking services without regard to time. There are several types of automatic teller machines: a machine for automatically dispensing currency note developed and utilized for computerizing baking business (referred to as a currency note dispensing machine); and a machine for automatically depositing and dispensing the currency note (referred to as a currency note depositing/dispensing machine).

A deposit container, in which the currency note to be dispensed is stacked, mounted in the currency note dispensing machine is generally referred to as a cassette. A reflux deposition container in which the currency note to be dispensed is staked or received currency note is stacked mounted in the currency note depositing/dispensing machine is generally referred to as a recycle box.

The recycle box for the currency note depositing/dispensing machine includes a currency note depositing unit installed to a depositing section and having several rollers and a currency note dispensing unit installed to a dispensing section and having several rollers, because of simultaneously performing a depositing function and a dispensing function.

On the other hand, the cassette for the currency note dispensing machine includes a currency note dispensing unit installed to a dispensing section and having several rollers, because of performing a dispensing function only.

In addition, the cassette has a push plate for supporting and urging the currency note towards the currency note dispensing unit. As a result, pushing pressure is generated between the currency note and the rollers of the currency note dispensing unit by the push plate, so that the currency note is dispensed by rotation of the rollers of the currency note dispensing unit.

However, since a conventional cassette for the currency note dispensing machine is sized corresponding to a size of one kind of currency note, the currency note dispensing machine has to have separate cassettes for every kind of currency note. Although the size of the cassette can be adjusted, it is difficult to adjust the size according to a kind of money paper.

In addition, if the money paper stacked in the cassette of the currency note dispensing machine is exhausted, the cassette has to be filled with currency note. Accordingly, it is necessary to easily mount the cassette to a main frame of the currency note dispensing machine.

SUMMARY OF THE INVENTION

Accordingly, the present invention has been made to solve the above-mentioned problems occurring in the prior art, and an object of the present invention is to provide a cassette for a currency note dispensing machine, in which the cassette is slidably mounted to a main frame of the currency note dispensing machine to easily fill with currency note, and can receive various kinds of currency note containing domestic and foreign currencies by adjusting the position of a currency note guide.

In order to accomplish this object, there is provided a cassette for a currency note dispensing machine, comprising: a cassette housing formed in a box shape with an upper surface opened, in which currency note vertically stands up and stacks, slidably mounted to a main frame of the currency note dispensing machine, and having a groove for receiving sheet separating unit at one side of a rear plate so that currency note contacts with the sheet separating unit after one edge of the currency note is supported; and a push plate supporting the currency note stacked between a front plate of the cassette housing and the rear plate and coupled to a resilient member to press the currency note toward the rear plate of the cassette housing.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
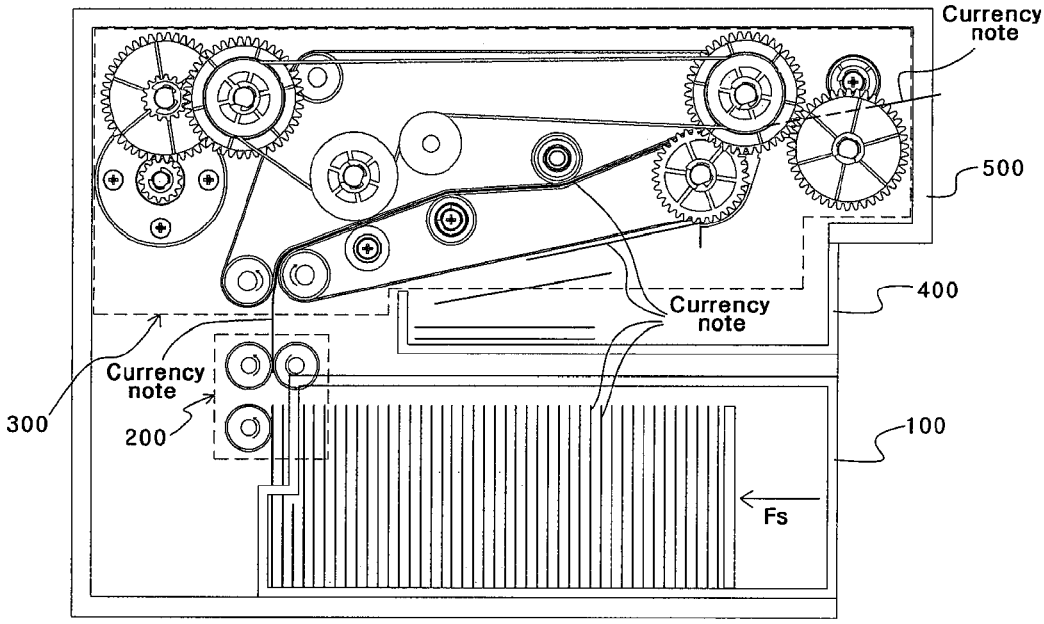
FIG. 1 is a schematic view of a cassette for a currency note dispensing machine according to an embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

FIG. 1 is a schematic view of a cassette for a currency note dispensing machine according to an embodiment of the present invention.

The cassette according to the present invention to be mounted to a currency note dispensing machine is illustrated and described by example.

For example, the currency note dispensing machine mainly includes a cassette 100 installed under a main frame 500 and filled with currency note, a sheet separating unit 200 for separating the currency note stacked in the cassette 100 sheet by sheet, a currency note feeding unit 300 for receiving and feeding the currency note from the sheet separating unit 200, and a withdrawing container 400 filled with currency note to be retrieved from the currency note feeding unit 300. $F_s$ shown in FIG. 1 means spring force.

In the cassette 100 shown in FIG. 1, the currency note vertically stands up and stacks therein, with a longitudinal side contacting with a bottom surface of the cassette 100. When the currency note stacked as described above is separated and fed, the currency note is fed in a horizontal direction (i.e., the short side) of the currency note. Accordingly, the shown currency note dispensing machine is called as a horizontal currency note dispensing machine.

Figure 2:
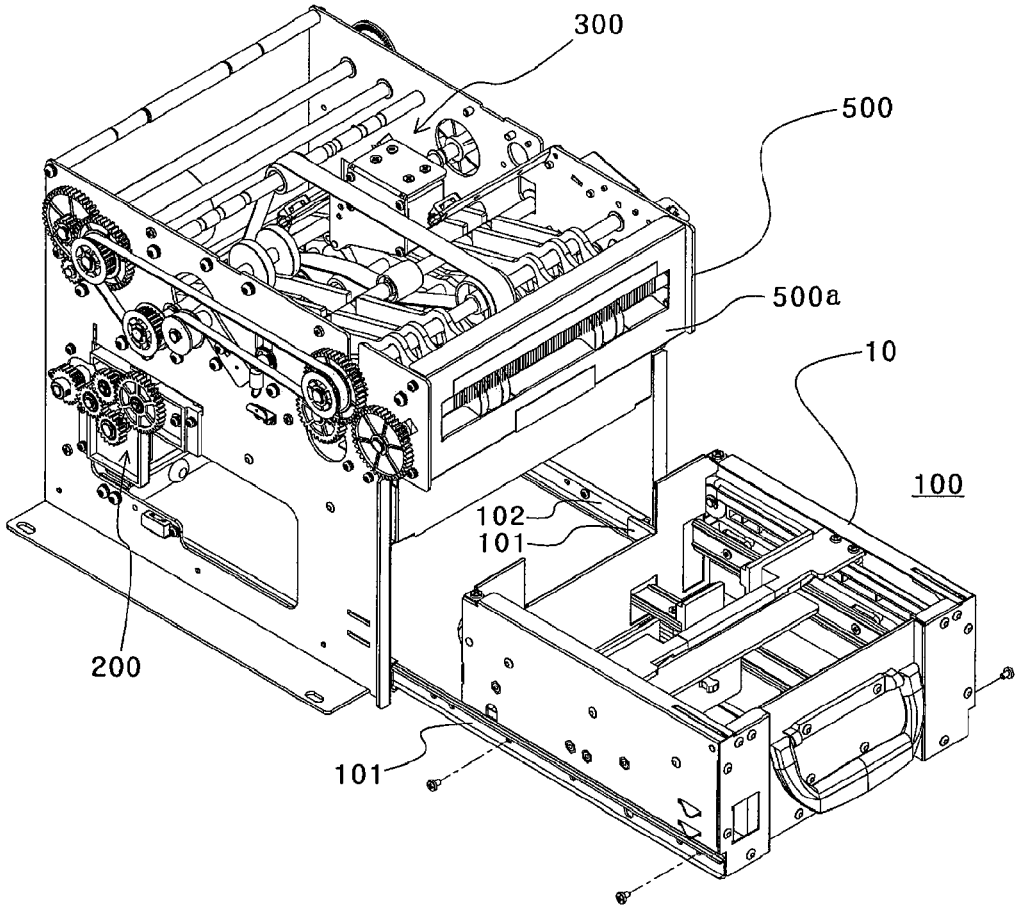
FIG. 2 is a perspective view of a cassette for a currency note dispensing machine according to an embodiment of the present invention.

FIG. 2 is a perspective view of the cassette for the currency note dispensing machine according to an embodiment of the present invention.

The cassette for the currency note dispensing machine according to an embodiment of the present invention is slidably mounted to the main frame 500 of the currency note dispensing machine along rail units 101 and 102, and is detached from a front surface of the machine, when the currency note is filled.

Specifically, the cassette 100 is provided with a male rail 101 at left and right side plates 13 of a cassette housing 10, and the main frame 500 is provided with a female rail 102 engaged with the mail rail 101, so that the cassette can slide into the main frame 500.

Preferably, in the state where the cassette 100 is completely exposed outwardly from the main frame 500, the male cassette 101 is not detached from the female cassette 102.

Specifically, since a conventional cassette can be separately carried from a main frame, a separate locking unit is required. However, the cassette 100 according to the present invention is not detached from the main frame 500, and is mounted or detached by a sliding structure, which is not necessary for a separate locking unit.

Figure 3:
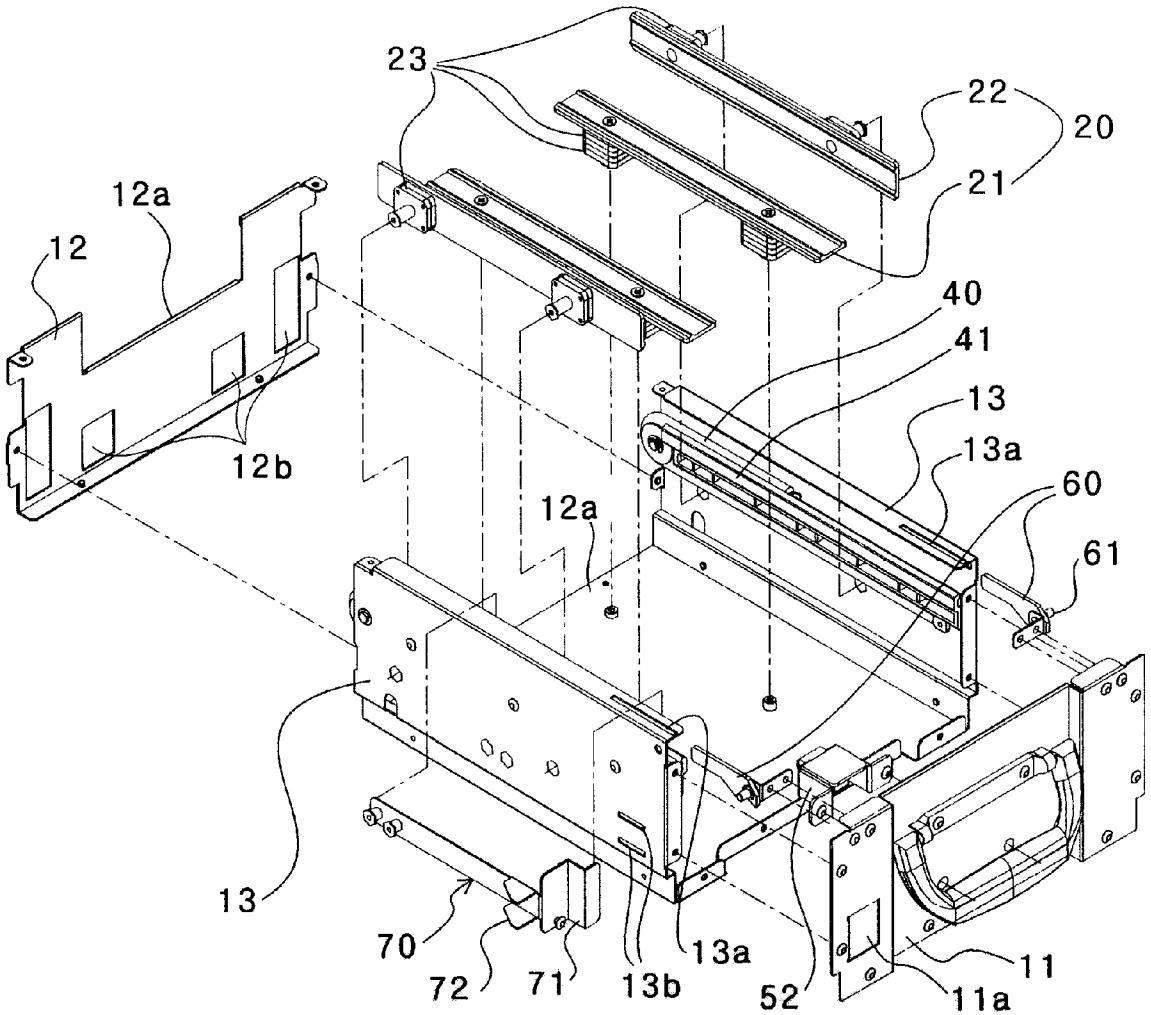
FIG. 3 is an exploded perspective view of a cassette for a currency note dispensing machine according to an embodiment of the present invention, in which a push plate is eliminated.
Figure 4:
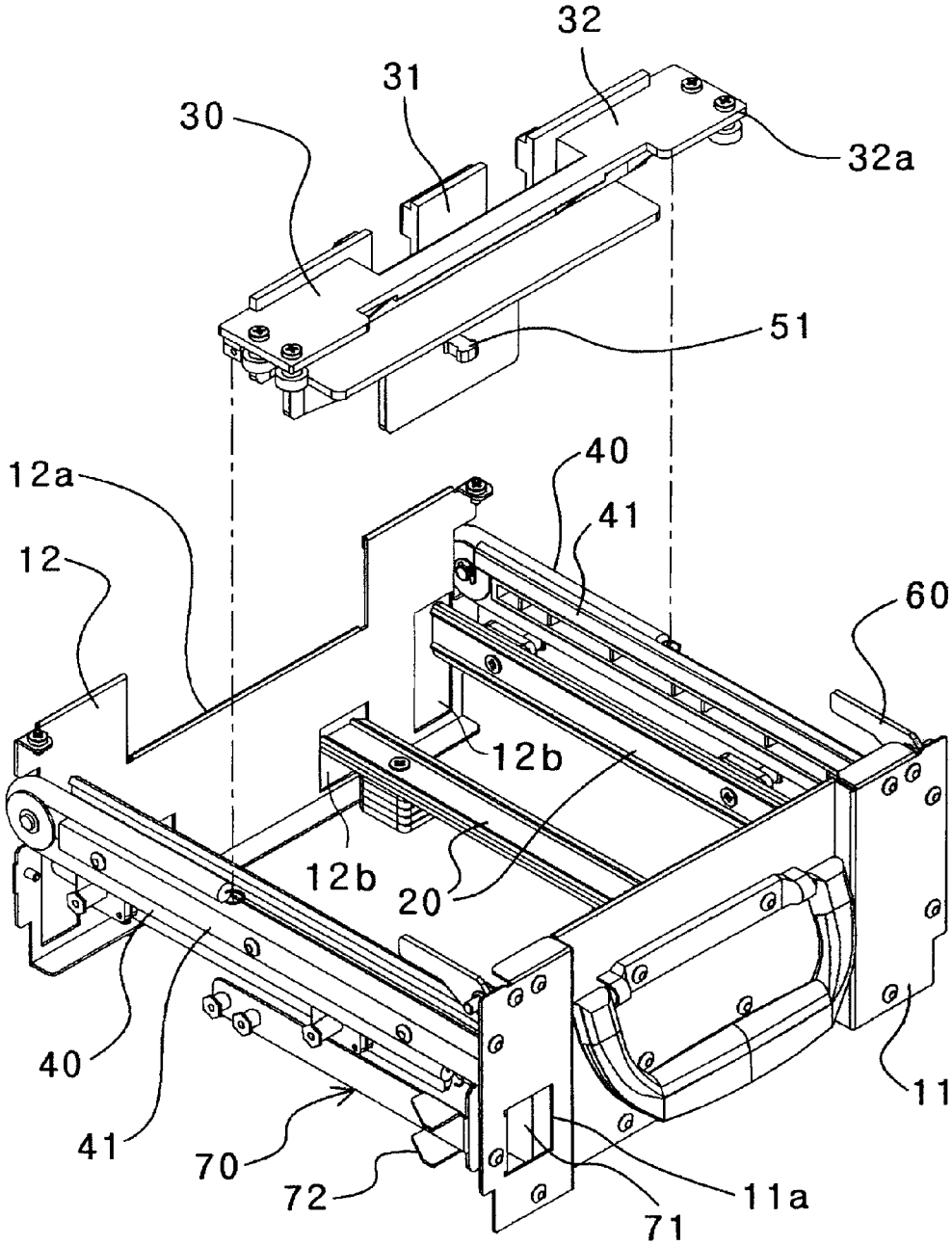
FIG. 4 is a perspective view of a cassette for a currency note dispensing machine according to an embodiment of the present invention, in which a side plate and a bottom plate are eliminated.
Figure 5:
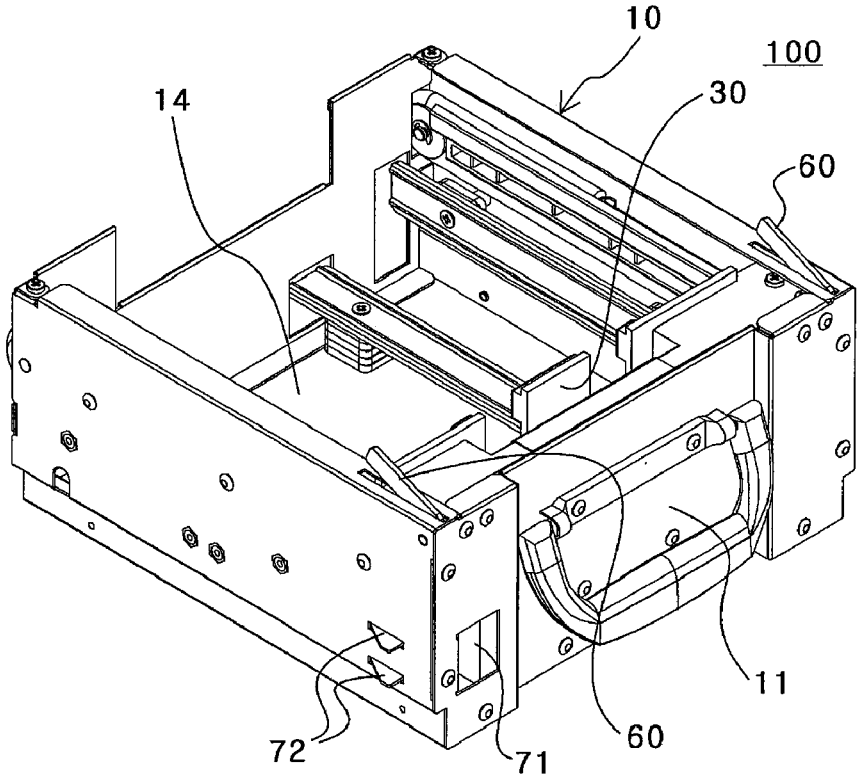
FIG. 5 is a perspective view of a cassette for a currency note dispensing machine according to an embodiment of the present invention, in which a push plate is disposed in a currency note filling position.
Figure 6:
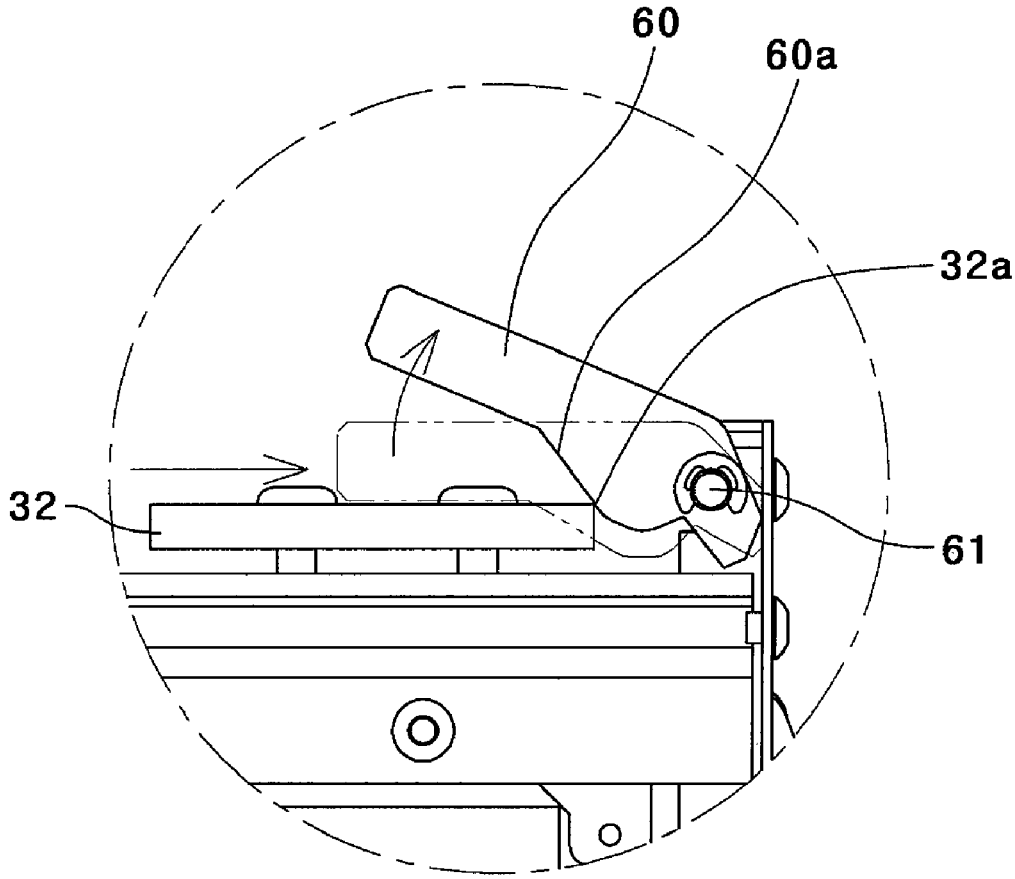
FIG. 6 is a detailed view showing that a wrong-mounting preventing member is pivoted upon a rotary shaft.

FIG. 3 is an exploded perspective view of the cassette for the currency note dispensing machine according to an embodiment of the present invention, in which a push plate is eliminated. FIG. 4 is a perspective view of the cassette for the currency note dispensing machine according to an embodiment of the present invention, in which a side plate and a bottom plate are eliminated. FIG. 5 is a perspective view of the cassette for the currency note dispensing machine according to an embodiment of the present invention, in which the push plate is disposed in a currency note filling position. FIG. 6 is a detailed view showing that a wrong-mounting preventing member is pivoted upon a rotary shaft.

The cassette housing 10 includes a front plate 11 with a handle, a rear plate 12 formed with a groove 12*a* for establishing the sheet separating unit 200 having a roller forcibly contacting with the currency note and separating the currency note, left and right side plates 13 installed to left and right sides of the front and rear plates 11 and 12, and a bottom plate 14 installed to the front plate 11, the rear plate 12 and the left and right plates 13.

A space between the front plate 11 and the rear plate 12 is filled with the currency note, and a push plate assembly 30 is movably installed in the space.

One side of the currency note is supported by the rear plate 12, and the other side of the currency note is supported by the push plate assembly 30.

The push plate assembly 30 includes a push plate 31 pressing the currency note toward the rear plate 12 and a bracket 32 for fixing the push plate 31.

The push plate assembly 30 is coupled to one end of the resilient member, i.e., a spring 40, installed to an inside of each left and right side plates 13, and is constantly pulled towards the rear plate 12 by the spring 40 to press the currency note toward the rear plate.

This is because the currency note stacked in the cassette is forcibly contacted with the separating unit 200 installed to the groove 12*a* to smoothly separate the currency note.

The spring 40 is provided to the insides of the left and right side plates 13 by a spring guide 14.

The push plate assembly 30 is provided with a male latch 51 at a side contacting with the currency note, and the front plate 11 is provided with a female latch 52 at a side opposite to the push plate 30.

When the cassette housing 10 is filled with the currency note, the push plate assembly 30 is closely contacted with the front plate 11, and the male latch 51 is engaged to the female latch 52. The push plate assembly 30 keeps the close touching state against the force of the spring 40 to easily fill the currency note.

In addition, preferably, the male latch 51 is disengaged from the female latch 52 through one-touch manner.

Specifically, in the state that the push plate assembly 30 is in closely contact with the front plate 11 by fitting the male latch 51 into the female latch 52, if the push plate assembly 30 is pressed towards the front plate 11 by further pushing the push plate, the male latch 51 is detached from the female latch 52 in a "one-touch" manner.

The cassette housing 10 includes a currency note guide 20 so that various kinds of currency note can be stacked therein.

The currency note guide 20 consists of a lower guide 21 installed to the bottom plate 14 for supporting a lower end of the currency note and a side guide 22 installed to the left and right side plates 13 for guiding left and right edges of the currency note.

In addition, a plurality of spacers 23 having a thickness of about 3 mm are provided between the lower guide 21 and the bottom plate 14, and between the side guide 22 and the left and right side plates 13. The size of the stacking space may be adjusted by selecting the number of the spaces corresponding to length and width of the currency note to be stacked.

The push plate assembly 30 is adapted to constantly press the currency note towards the rear plate 12 so that the currency note may be smoothly separated by the sheet separating unit 200.

However, in the state that the push plate assembly 30 is closely contacted with the front plate 11 by fitting the male latch 51 into the female latch 52, after an operator completes the filing of the currency note, if the operate mounts the cassette 100 to the main frame 500 without releasing the male latch 51 from the female latch 52, the push plate assembly 30 does not press the currency note. Therefore, the pushing force sufficient for separation of the currency note is not applied to the currency note, so that the payment of the currency note is not achieved in the currency note dispensing machine.

In addition, as shown in FIGS. 3 and 4, a plurality of spacers 23 are provided between the lower guide 21 and the bottom plate 14, and between the side guide 22 and the left and right side plates 13. The rear plate 12 is provided with holes 12*b*.

The cassette housing 10 also includes a wrong-mounting preventing member 60 for the push plate so that the cassette housing is prevented from being mounted to the main frame 500 when the push plate assembly 30 is not disposed at a paper pressing position. The paper pressing position means the position of the push plate assembly 30 when the push plate assembly 30 is pressing one side of the currency note.

The wrong-mounting preventing member 60 for the push plate is installed to the insides of the left and right side plates 13.

Referring to FIG. 6, the wrong-mounting preventing member 60 includes an inclined edge portion 60*a* and pivots upon a rotary shaft 61.

The left and right side plates 13 are formed with a pivot slot 13*a* through which the wrong-mounting preventing member 60 is protruded.

Referring to FIGS. 5 and 6, when the push plate assembly 30 is moved towards the currency note filling position, i.e., the front plate 11, the inclined edge portion 60*a* of the wrong-mounting member 60 is contacted with a edge portion 32*a* of the bracket 32, which causes the wrong-mounting member 60 to pivot around the rotary shaft 61 to protrude from the upper side of the cassette housing 10, as shown in FIG. 5.

Accordingly, the operator can visually perceive that the push plate assembly 30 is disposed in the currency note pressing position in the cassette 100. Although visually not perceiving the state, the wrong-mounting preventing member 60 protruding from the upper side of the left and right side plates 13 is caught by a front portion 500*a* of the main frame 500 when the cassette 100 slides into the main frame 500. As a result, any banking accident due to the wrong mounting of the push plate assembly 30 may be prevented in the currency note dispensing machine.

The cassette 100 also includes a release preventing member 70 so that after the cassette is mounted to the main frame 500 it is inadvertently slid.

Specifically, the release preventing member 70 has one side installed to the insides of the left and right side plate 13 and the other side exposed from a handle slot 11*a* of the front plate 11. A stopping boss 72 penetrates the through-hole 13*b* of the left and right side plates 13.

As a result, although the stopping boss 72 is protruded when the cassette 100 is mounted to the main frame 500, the stopping boss is inclined. The stopping boss is pressed by the main frame 500, and thus the cassette is slidingly mounted to the main frame. When the cassette is detached from the main frame, by pressing the release preventing member 70 exposed from the slot 11*a* of the front plate 11 in one direction, the release preventing member 70 is bent inwardly around a fixing position, and thus the stopping boss 72 is introduced into the left and right side plates 13.

At that time, the cassette 100 is slid by pulling the handle of the front plate 11 forwardly.

With the above description, the cassette may be slidably mounted to easily fill with currency note, and can receive various kinds of currency note by adjusting a currency note guide. In addition, if an operator does not return the push plate to the currency note pressing position when filling, the cassette is not mounted to the frame, thereby preventing banking accidents.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cassette for a currency note dispensing machine, the cassette comprising:

a cassette housing formed in a box shape with an upper surface opened, in which currency notes vertically stand up and stack, the cassette housing being slidably mounted to a main frame of the currency note dispensing machine, and having a rear plate, a front plate opposite the rear plate, a first side plate, a second side plate opposite the first side plate and a bottom plate, the rear plate having a groove through which each of the currency notes contacts with a roller of a sheet separating unit to be separated one by one by the roller;

a push plate supporting the currency notes and positioned between the front plate and the rear plate and coupled to a resilient member to press the currency notes toward the rear plate;

a currency note guide comprising a lower guide extending along the bottom plate away from the bottom plate and positioned to place and support an underside of a stack of the currency notes on the lower guide, and a side guide extending along the first side plate away from the first side plate and positioned to support a side of the stack of the currency notes in the cassette housing;

a first plurality of spacers provided and accumulated in the vertical direction between the lower guide and the bottom plate to control a spacing of the lower guide apart from the bottom plate by changing the number of spacers included in the first plurality of spacers;

a second plurality of spacers provided and accumulated in the horizontal direction between the side guide and the first side plate to control a spacing of the side guide apart from the first side plate by changing the number of spacers included in the second plurality of spacers; and a wrong-mounting preventing member configured to prevent the cassette from being inserted into the currency note dispensing machine when the push plate is not disposed at a paper pressing position;

wherein the wrong-mounting preventing member pivots upon a rotary shaft attached to the front plate when the wrong-mounting preventing member is moved by a bracket attached to the push plate, such that the wrong-mounting preventing member protrudes through a pivot slot located at an upper flange of at least one of the first and second side plates.

2. The cassette of claim 1, wherein the push plate comprises a male latch configured to engage a female latch located in the front plate when the push plate is disposed at a currency filling position and to disengage from the female latch when the push plate is pushed towards the front plate from the currency filling position.

3. The cassette of claim 1, further comprising a release preventing member configured to prevent the cassette from being released from the currency note dispensing machine, the release preventing member comprising:

a side member attached to one of the first and second side plates;

a front member accessible through a handle slot of the front plate; and a stopping boss attached to the side member and penetrating a through hole of the one of the first and second side plates;

wherein the cassette is configured to allow an operator to push the front member through the handle slot to move the stopping boss inwardly so that the cassette is released from the currency note dispensing machine.

4. The cassette of claim 1, wherein the resilient member is located in at least one of the first and second side plates and guided by a spring guide.

5. The cassette of claim 1, wherein the rear plate is provided with holes.

6. A cassette for a currency note dispensing machine, the cassette comprising:

a cassette housing formed in a box shape with an upper surface opened, in which currency notes vertically stand up and stack, the cassette housing being slidably mounted to a main frame of the currency note dispensing machine, and having a rear plate, a front plate opposite the rear plate, a first side plate, a second side plate opposite the first side plate and a bottom plate, the rear plate having a groove through which each of the currency notes contacts with a roller of a sheet separating unit to be separated one by one by the roller;

a push plate supporting the currency notes and positioned between the front plate and the rear plate and coupled to a resilient member to press the currency notes toward the rear plate, wherein the resilient member is located in at least one of the first and second side plates and guided by a spring guide;

a currency note guide comprising a lower guide extending along the bottom plate away from the bottom plate and positioned to place and support an underside of a stack of the currency notes on the lower guide, and a side guide extending along the first side plate away from the first side plate and positioned to support a side of the stack of the currency notes in the cassette housing;

a first plurality of spacers provided and accumulated in the vertical direction between the lower guide and the bottom plate to control a spacing of the lower guide apart from the bottom plate by changing the number of spacers included in the first plurality of spacers;

a second plurality of spacers provided and accumulated in the horizontal direction between the side guide and the first side plate to control a spacing of the side guide apart from the first side plate by changing the number of spacers included in the second plurality of spacers;

a wrong-mounting preventing member configured to prevent the cassette from being inserted into the currency note dispensing machine when the push plate is not disposed at a paper pressing position, wherein the wrong-mounting preventing member pivots upon a rotary shaft attached to the front plate when the wrong-mounting preventing member is moved by a bracket attached to the push plate, such that the wrong-mounting preventing member protrudes through a pivot slot located at an upper flange of at least one of the first and second side plates; and a release preventing member configured to prevent the cassette from being released from the currency note dispensing machine, the release preventing member comprising: a side member attached to one of the first and second side plates; a front member accessible through a handle slot of the front plate; and a stopping boss attached to the side member and penetrating a through hole of the one of the first and second side plates, wherein the cassette is configured to allow an operator to push the front member through the handle slot to move the stopping boss inwardly so that the cassette is released from the currency note dispensing machine;

wherein the push plate comprises a male latch configured to engage a female latch located in the front plate when the push plate is disposed at a currency filling position, and the male latch is configured to disengage from the female latch through a one-touch manner when the push plate is pushed towards the front plate from the currency filling position.

* * * * *